US008477974B2

(12) United States Patent
Arndt

(10) Patent No.: US 8,477,974 B2
(45) Date of Patent: Jul. 2, 2013

(54) HEARING DEVICE AND METHOD FOR PRODUCING AN OMNIDIRECTIONAL DIRECTIONAL CHARACTERISTIC

(75) Inventor: Georg-Erwin Arndt, Obermichelbach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 145 days.

(21) Appl. No.: 13/050,094

(22) Filed: Mar. 17, 2011

(65) Prior Publication Data

US 2011/0228961 A1 Sep. 22, 2011

(30) Foreign Application Priority Data

Mar. 17, 2010 (DE) ..... 10 2010 011 730

(51) Int. Cl.
*H04R 25/00* (2006.01)

(52) U.S. Cl.
USPC ..... 381/313; 381/318; 381/320

(58) Field of Classification Search
USPC ..... 381/312, 313, 314, 317, 318, 320, 381/321
See application file for complete search history.

(56) References Cited

U.S. PATENT DOCUMENTS

| | | | | |
|---|---|---|---|---|
| 7,212,642 | B2 | 5/2007 | Rasmussen | |
| 2004/0258249 | A1 | 12/2004 | Niederdrank et al. | |
| 2005/0008166 | A1* | 1/2005 | Fischer et al. | 381/60 |
| 2009/0268933 | A1 | 10/2009 | Baechler | |

FOREIGN PATENT DOCUMENTS

| | | | |
|---|---|---|---|
| EP | 1 489 882 | A2 | 12/2004 |
| WO | 2004057914 | A1 | 7/2004 |
| WO | 2008071236 | A2 | 6/2008 |

* cited by examiner

*Primary Examiner* — Tuan D Nguyen
(74) *Attorney, Agent, or Firm* — Laurence A. Greenberg; Werner H. Stemer; Ralph E. Locher

(57) ABSTRACT

A hearing device is provided with a microphone array having a plurality of microphones. The signals from the microphones can then be processed by an appropriate apparatus of the hearing device such that this results in a directivity of the microphone array. The apparatus must also be able to allow an omnidirectional directivity of the microphone array, i.e. a non-directional detection of sound. This is not always ensured in the case where one of the microphones in the microphone array is covered or aligned other than what is intended. An omnidirectional directivity of the microphone array is ensured in a hearing device of the invention. Here, the microphones are, for this purpose, connected to inputs of the apparatus via a coupling device, by way of which each of the microphones can be coupled to a plurality of inputs of the apparatus at the same time.

8 Claims, 2 Drawing Sheets

HEARING DEVICE AND METHOD FOR PRODUCING AN OMNIDIRECTIONAL DIRECTIONAL CHARACTERISTIC

CROSS-REFERENCE TO RELATED APPLICATION

This application claims the priority, under 35 U.S.C. §119, of German patent application DE 10 2010 011 730.7, filed Mar. 17, 2010; the prior application is herewith incorporated by reference in its entirety.

BACKGROUND OF THE INVENTION

Field of the Invention

The invention relates to a hearing device with a microphone array having at least a first microphone and a second microphone. An apparatus produces a directivity of the microphone array. The first microphone can be connected to a first input of the apparatus and the second microphone to a second input of the apparatus.

The invention also relates to a method for producing an omnidirectional directional characteristic for such a hearing device. Here, the term hearing device is understood to mean a hearing aid in particular. Additionally, the term however also includes other portable acoustic appliances, such as headsets, headphones or the like.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal, RIC) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction receiver. The amplifier is usually integrated into a signal-processing unit. This basic design is illustrated in FIG. 1 using the example of a behind-the-ear hearing aid. One or more microphones 2,2' for recording the sound from the surroundings are installed in a hearing-aid housing 1 to be worn behind the ear. A signal-processing unit (SPU) 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery (BAT) 5, likewise integrated into the hearing-aid housing 1, supplies the hearing aid and, in particular, the signal-processing unit 3 with energy.

In an array of microphones, as formed in an exemplary fashion by the microphones 2 and 2' in the example in FIG. 1, a sound generally brings about a microphone signal in both microphones 2, 2'. Here the microphone signals differ from one another depending on the direction from which the sound impinges on the array. Combining the individual microphone signals to a single signal affords the possibility of damping the combined signal, which damping is dependent on the direction of incidence of the sound. Such direction-dependent damping is called the directivity or directional characteristic of the microphone array.

FIG. 2 shows a signal-flow diagram of typical processing of microphone signals, as can be performed by an appropriate apparatus 10 for producing such directivity.

The apparatus 10 comprises delay elements 20, 22. A delay element allows the production of an output signal that is modified with respect to an input signal as would be the case if the signal were delayed by a time $\tau_i$. By way of example, this can be brought about by modifying a phase of spectral components of the signal. By way of example, the delay $\tau_i$ can be set to a period of time that sound requires to overcome the distance 36 between the microphones 2, 2'.

The apparatus 10 moreover comprises adders 24, 26, 28 for respectively superposing two signals. One input signal of an adder may be inverted before the superposition. In FIG. 2, such an inversion is indicated by a minus sign. The apparatus 10 moreover comprises a multiplier 30 for scaling a signal. To this end, the signal is multiplied by the factor a in the multiplier 30. The output signal produced by the apparatus 10 can be transmitted to a downstream apparatus via an output 32. By way of example, such a downstream apparatus can be a digital/analog converter, which produces an analog signal for a receiver, like the receiver 4.

In order to produce the directivity, the signals from the microphones 2 and 2' are processed in a lower signal branch—a cardioid branch 34—in the apparatus 10 such that, at the adder 28, there is a signal in which directionally dependent damping results in a cardioid-shaped directional characteristic of the array comprising the microphones 2 and 2'. Such a cardioid directional characteristic is typical for a first-order differential microphone array. Here, the cardioid directional characteristic is oriented such that a sound signal, propagating along a direction 38, is subjected to the least damping. In the case where a user wears the hearing aid shown in FIG. 1, the direction 38 corresponds to the direction of sound that impinges frontally on the user from the front.

An anti-cardioid branch 40 brings about an anti-cardioid directional characteristic in the apparatus 10. This means that sound impinging frontally on the user from the direction 38 is subjected to the most damping. By contrast, sound propagating against the direction 38, i.e. impinging on the user from behind, causes the most pronounced signal in the branch 40.

Selecting a value for the factor a affords the possibility of determining the influence of the branch 40 on the signal at the output 32. If the factor a is set to a value of zero, i.e. a=0, the anti-cardioid branch 40 has no influence on the output signal. Then the apparatus 10 overall produces a cardioid characteristic for the array comprising the microphones 2 and 2'. By contrast, if the factor a is set to a value of one, additional signals reach the output 32 via the branch 40. In this case, the direction from where the sound comes from has no relevance to the array of microphones 2, 2'. A sound signal is then always damped to the same extent. This type of directional characteristic is referred to as omnidirectional.

Varying a directional characteristic between a cardioid directional characteristic and an omnidirectional directional characteristic in the apparatus 10 can be very important to a user of a hearing aid. In order to be able to concentrate on a conversation with a person, who is standing in front of the user and whose voice therefore comes from the direction 38, directional sound detection is preferably desired. By contrast, if sounds should be perceived clearly from all directions, a user may consider it desirable to be able to set an omnidirectional directional characteristic.

However, the mode of action of an apparatus for producing a directivity, explained using the example of the apparatus 10 in FIG. 2, is always based on the assumption that sound is able to reach all microphones of the microphone array in an unhindered fashion. However, this is not always the case, particularly in the case of hearing aids. By way of example, hair of a user may cover an access opening to one of the microphones. Then the sound only reaches this microphone in a damped fashion. This results in a modified directional characteristic for the branches 34 and 40. Hence, setting the factor a may no longer result in a desired switch of the directional characteristic of the microphone array between a cardioid directional characteristic and an omnidirectional directional characteristic. In the process, it is the omnidirectional directivity in particular that can no longer be produced as a result of one of the microphones 2 or 2' being covered. The damping of the sound at one of the microphones may for example result in other superposition effects than those envisaged in the superposition of signals in the adders 24 or 26.

A further disadvantage can emerge if the hearing aid on one ear of the user slips. The microphones are then no longer aligned as envisaged with respect to the head of the user. This can lead to shadowing of one of the microphones, as a result of which sound likewise only reaches this microphone in a damped fashion.

Commonly assigned patent application publication US 2004/0258249 A1 and its counterpart European published patent application EP 1 489 882 A3 describe a method for operating a hearing-aid device, in which various directional characteristics may be set. The hearing-aid device has three microphones, which are interconnected in pairs to form first-order directional microphones. The two microphone units with first-order directional characteristics are then used to form a microphone unit with a second-order directional characteristic.

SUMMARY OF THE INVENTION

It is accordingly an object of the invention to provide a hearing device and method for producing an omnidirectional directional characteristic which overcome the above-mentioned disadvantages of the heretofore-known devices and methods of this general type and which provides for an improved functionality of a hearing device to the extent that an omnidirectional directivity of the microphone array is allowed, even if the microphones of a microphone array in the hearing device are not in their intended positions.

With the foregoing and other objects in view there is provided, in accordance with the invention, a hearing device, comprising:

a microphone array including at least a first microphone and a second microphone;

an apparatus for producing a directivity of said microphone array, said apparatus having a first input and a second input; and a coupling device for coupling said first microphone to said first input of said apparatus and for coupling said second microphone to said second input of said apparatus;

said coupling device being configured to simultaneously couple said first microphone to both said first and second inputs of said apparatus; and said coupling device being configured to simultaneously couple said second microphone to both said first and second inputs of said apparatus.

In other words, the objects of the invention are achieved, first, by a hearing device as outlined and also by a novel method for producing an omnidirectional directional characteristic as claimed.

The hearing device according to the invention has a microphone array comprising at least a first and a second microphone, and an apparatus for producing a directivity of the microphone array. Means for coupling can couple the first microphone to a first input of the apparatus and the second microphone to a second input of the apparatus. The means for coupling in this case are designed so as to couple the first microphone to both inputs at the same time. An advantage of the hearing device according to the invention is that an omnidirectional directional characteristic can already be produced solely on the basis of a signal from the first microphone. It goes without saying that the microphone array in the hearing device according to the invention may comprise more than two microphones. Then the means for coupling are accordingly designed to couple each of the microphones to a respective input of the apparatus. The means for coupling are additionally designed also to couple the second microphone to both inputs at the same time. An advantage arising from this is that the omnidirectional directional characteristic can be brought about either with the first or with the second microphone. Depending on which of the two microphones is for example covered by hair, use can then be made of the respective other microphone. Moreover, it is possible to cross-fade continuously between a directional characteristic with high directivity, i.e. a strongly pronounced directional selectivity, and the omnidirectional directional characteristic.

When the omnidirectional directional characteristic is produced by means of the individual, first microphone, the signal thereof is routed via the apparatus for producing the directivity, as in the case of directed sound detection. As a result, the transfer characteristic of this apparatus is impressed onto the processed signal in both directed and undirected sound detection. An advantage resulting from this is that those apparatuses that are connected downstream of the apparatus for producing the directivity do not have to be adjusted dependent on whether the sound is detected in a directed or undirected fashion.

By always routing the signals via the apparatus for producing the directivity, the phases of the signals in individual channels of an analysis-synthesis filter-bank arrangement are also always modified in the same fashion by the apparatus for producing the directivity. Hence, it is possible to provide omnidirectional sound detection in one channel and provide a directed sound detection in e.g. a spectrally immediately adjacent channel. Within the scope of omnidirectional sound detection by means of the single first microphone, likewise modifying the phase of the microphone signal by the apparatus for producing the directivity ensures that the individual channels in the synthesis filter bank can be combined with one another without artifacts.

By contrast, if the apparatus for producing the directivity were simply bypassed for the omnidirectional sound detection, there could be crackling or similar artifacts during the switch over.

The means for coupling preferably allow selective interruption of a signal path from the second microphone to the apparatus for producing the directional characteristic. Then there is no interference in the microphone signal from the first microphone as a result of a superposition with the microphone signal from the second microphone. The interruption is selective in this case, i.e. the second microphone can be re-coupled to the apparatus at any time for producing a directional characteristic.

In a development of the hearing device according to the invention, the means for coupling comprise a delay element, via which the first microphone can be coupled to the second input. As a result, this compensates for an influence of delay elements within the apparatus, which delay elements allow the production of the directivity. An advantage resulting from this is that the apparatus for producing the directivity in the hearing device according to the invention can be the same as is also used in hearing aids from the prior art. There is no need to provide a special apparatus.

A particular advantage arises here if the delay element is a component of the apparatus itself. Then there is no need to provide an additional delay element, but use is made of a delay element already provided by the apparatus for producing the directivity. This results in a hearing device according to the invention that can be implemented in a particularly simple fashion.

The means for coupling preferably comprise at least one apparatus for multiplying a microphone-signal amplitude by a weighting factor. Here, the weighting factor may also be a complex number. By setting an appropriate weighting factor, an apparatus for multiplying, or a multiplier, advantageously makes it possible to fix a degree of coupling between a microphone and one of the inputs by setting the weighting factor. Complete decoupling arises in this case if the weighting factor is equal to zero.

In this context, a partial coupling should be understood to mean that the microphone signal from a microphone is weighted by a weighting factor b, which lies between zero and one, i.e. $0<b<1$. If, via the means for coupling, this microphone is at the same time coupled to a plurality of inputs of the apparatus for producing the directional characteristic and if, additionally, the second microphone is likewise also coupled to a plurality of inputs, an advantage arises if the second microphone is weighted by a weighting factor c, and here $c=1-b$. An advantage arising from this linking of the weighting factors is that, in order to bring about an omnidirectional directional characteristic, a component of the respective microphone signals can be modified continuously in an output signal of the apparatus, without this resulting in undesired side-effects or artifacts. By way of example, an undesirably loud output signal at the output of the apparatus can be such a side-effect.

The hearing device according to the invention is also advantageously developed if, in the means for coupling, a weighting of a microphone-signal amplitude and/or a delay of the microphone signal is a function of a microphone-signal frequency. An advantage arising from this is that it is possible to account for a ratio between a spacing of the microphones and a wavelength of a sound that causes the microphone signals.

The invention also includes a method for producing an omnidirectional directional characteristic for a hearing device. Here, the method is suitable for such a hearing device in which microphones of a microphone array can be coupled to respective inputs of an apparatus for producing a directivity of the microphone array. The apparatus thus has a separate input for each of the microphones, via which input a microphone signal can be received by the apparatus. According to the method according to the invention, two of the microphones are each coupled to at least two of the inputs of the apparatus for producing an omnidirectional directional characteristic.

As in the case of the hearing device according to the invention, this is advantageous in that an omnidirectional directivity can be produced on the basis of a microphone signal from merely one of the microphones. It goes without saying that the method according to the invention can be developed in accordance with the previously described developments of the hearing device according to the invention. This then also results in the corresponding additional advantages.

Other features which are considered as characteristic for the invention are set forth in the appended claims.

Although the invention is illustrated and described herein as embodied in a hearing device and method for producing an omnidirectional directional characteristic, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 3:
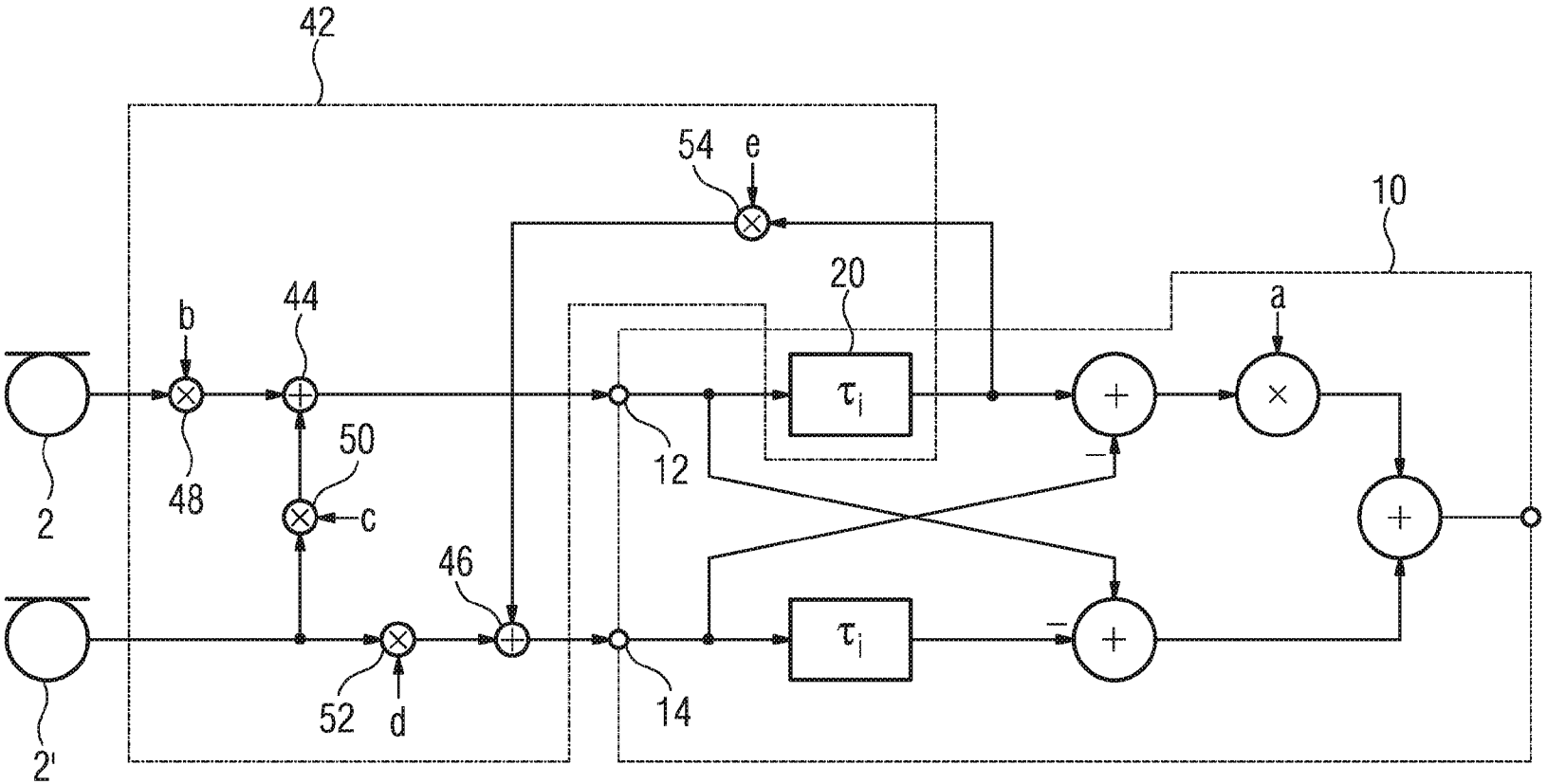
FIG. 3 shows a signal-flow diagram for signal processing that arises in an embodiment of a hearing device according to the invention.

Referring now once more to the figures of the drawing in detail, FIG. 3 shows a signal-flow diagram for signal processing that can be performed in a hearing aid, for example a behind-the-ear hearing aid.

Figure 1:
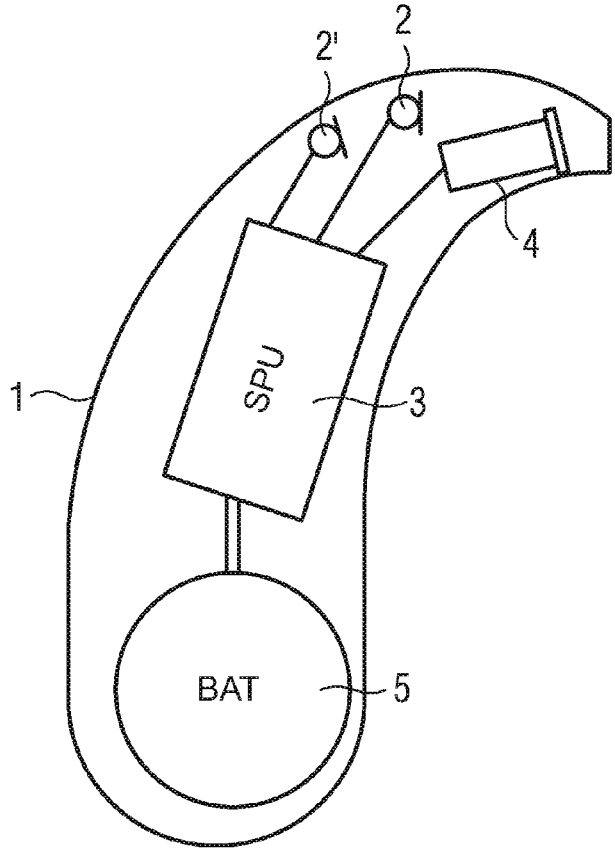
FIG. 1 PRIOR ART
FIG. 1 shows a schematic illustration of a design of a behind-the-ear hearing aid according to the prior art.
Figure 2:
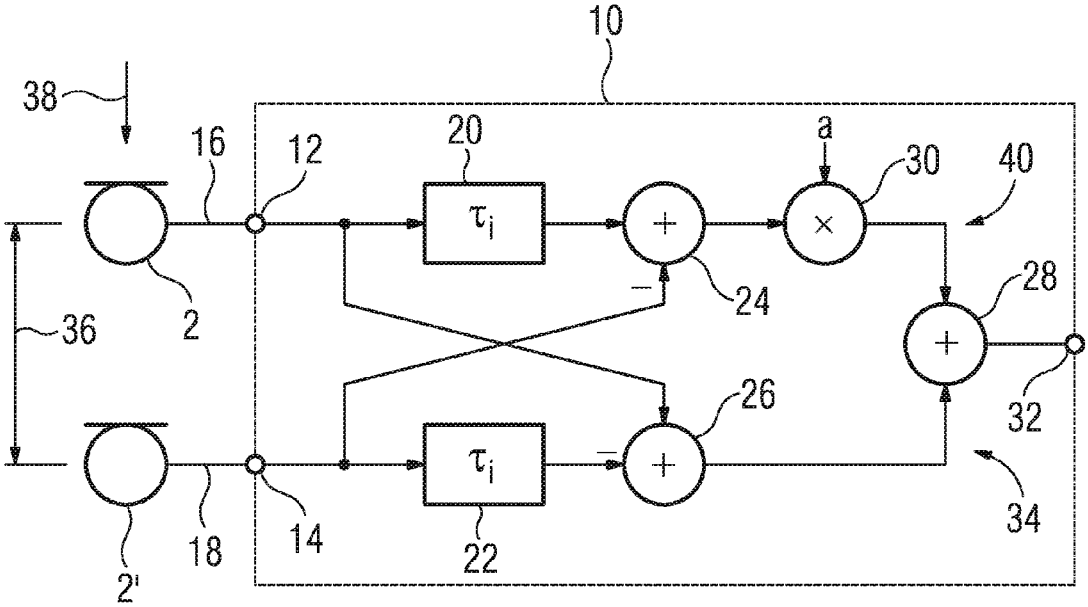
FIG. 2 PRIOR ART
FIG. 2 shows a signal-flow diagram for signal processing in a hearing aid, which brings about a directivity of a microphone array as per the prior art.

The hearing aid has an array of two microphones 2, 2', the functionality of which corresponds to the microphones illustrated in FIGS. 1 and 2. It is for this reason that the microphones 2 and 2' in FIG. 3 have been denoted by the same reference sign. The microphones 2, 2' shown in FIG. 3 can be microphones without their own directional characteristic, i.e. sound then causes a microphone signal in each of the microphones 2, 2', which microphone signal is independent of a direction from which the sound impinges on the respective microphone.

In the example illustrated in FIG. 3, the hearing aid also has an apparatus 10 for producing a directivity of the array comprising the two microphones 2 and 2'. By way of example, the apparatus 10 can be provided as a signal-processing program in the signal-processing unit in the hearing aid. In terms of its functionality, the apparatus 10 corresponds to the apparatus explained in conjunction with FIG. 2. It is for this reason that elements, which correspond to elements in the apparatus shown in FIG. 2, are denoted by the same reference sign in FIG. 3 as they are in FIG. 2.

The microphones 2 and 2' are connected, or coupled, to inputs 12, 14 of the apparatus 10 via coupling means 42, which will also be referred to as a coupling device 42 in this specification. The coupling device 42 connects the microphones 2, 2' to the inputs 12, 14. The device or means 42 comprise adders 44, 46 and multipliers 48, 50, 52, 54. The microphone 2 is coupled to the adder 44 via the multiplier 48. The multiplier 48 allows the weighting of the microphone signal of the microphone 2 by a weighting factor b. The microphone 2' is coupled to the adder 44 via the multiplier 50, the multiplier 50 allowing the weighting of the microphone signal of the microphone 2' by a factor c. The adder 44 is coupled to the input 12 of the apparatus 10. The microphone 2' is coupled to the adder 46 via the multiplier 52, the multiplier 52 weighting the microphone signal by a weighting factor d.

The means 42 also comprise the delay element 20 of the apparatus 10. Here, an output of the delay element 20 is coupled to the adder 46 via the multiplier 54. The multiplier 54 weights the output signal of the delay element 20 by a weighting factor e. The adder 46 is coupled to the input 14 of the apparatus 10.

The means 42 can each comprise a multiplicity of further elements, which are not illustrated in any more detail in FIG. 3. By way of example, they can each comprise a microphone preamplifier and an analog/digital converter.

The means 42 afford the possibility of producing an omnidirectional directional characteristic of the array comprising the microphones 2, 2' by setting the factors b, c, d and e. By way of example, the following settings are possible:

Setting 1: b=1; c=0; d=0; e=1

The microphone 2 is coupled to both inputs 12, 14. In this case, it is directly coupled to the input 12. The microphone 2 is coupled to the input 14 via the delay element 20. By contrast, the microphone 2' is not coupled to the apparatus 10. The delay $\tau_i$ of the delay element 20 can correspond to a run time of a sound signal between the two microphones 2 and 2'. Then there is a delay of the signal at both inputs 12 and 14 that is the same as in the microphone array shown in FIG. 2 if a sound signal impinges on the microphone array from the direction 38.

However, in contrast to the arrangement shown in FIG. 2, both the signal at the input 12 and the signal 14 are, in setting 1, based on the microphone signal from the microphone 2. By way of example, this is advantageous if the hearing aid on the ear of a user has slipped and this results in the microphone 2' being shadowed. In this case, omnidirectional directivity can no longer be brought about by only the apparatus 10. By contrast, by decoupling the microphone 2' and coupling the microphone 2 to both inputs 12, 14 of the apparatus 10 as per setting 1, an omnidirectional directivity can be provided.

Setting 2: b=0; c=1; d=0; e=1

This results in a comparable functionality of the hearing aid as in setting 1, with, however, the microphone 2' in this case being coupled to the inputs 12, 14, whereas the microphone 2 is decoupled from the apparatus 10.

Setting 3: b=1; c=0; d=1; e=0

As a result of this setting, the means 42 provide the same coupling as is also brought about by the coupling elements 16, 18 in the structure shown in FIG. 2. In other words, the means 42 can also operate the apparatus 10 in a manner known from the prior art.

Further Settings:

It goes without saying that the factors b, c, d and e can also be set to arbitrary values. The factor a can, of course, also be set to values that differ from zero and one.

The values can likewise be adjusted, e.g. automatically, depending on parameters of the surroundings. In other words, the factors of the multipliers are then set in adaptive fashion, e.g. depending on other control parameters during operation of the hearing aid.

Setting a value $0 \leqq b \leqq 1$ and $c=1-b$ can ensure that there may be manual or automatic cross-fade between an omnidirectional directional characteristic on the basis of a single microphone, on the one hand, and directional sound detection, for example with a cardioid directional characteristic, without this resulting in bothersome artifacts in the output signal.

The means 42 for coupling the microphones 2, 2' to the inputs 12, 14 affords the possibility of merely coupling one of the two microphones to both inputs of the apparatus 10. In place of different microphone signals, there now is directional processing of amplitude and phase of signals in the unit 10 on the basis of a single microphone signal. This ensures that there can also be an omnidirectional directivity of the array comprising the microphones 2 and 2' if one of the two microphones is covered or the hearing aid has slipped.

In the means 42 and the apparatus 10, the delay $\tau_i$ and the factors a, b, c, d and e may be provided as a function of a frequency. Then there is a correspondingly different processing of signal components at different frequencies.

Frequency-dependent coupling of the microphones to the inputs of the apparatus 10, which coupling can also be set via the factors b, c, d and e, allows the provision of an omnidirectional directional characteristic in a particularly reliable fashion. However, likewise, conventional processing of the signals is also possible.

By way of example, sub-band processing, in which the microphone signals are split into individual frequency channels, can allow frequency-dependent processing.

The apparatus 10, shown in FIG. 3, for producing a directivity can, of course, also have a different arrangement of delay elements, adders and multipliers, and further elements. Then it is possible to produce other directional characteristics than a cardioid directional characteristic.

The example shows how an expedient compromise in satisfying the following requirements is made possible with the aid of the hearing device according to the invention:

providing a directivity of a microphone array;
allowing a large gain of the microphone signals;
avoiding noise by the signal processing; and
adapting signal processing to the geometry of the microphone array.

In particular, an option is shown for ensuring an omnidirectional directivity of a microphone array, even in the case of unpredicted conditions in the sound detection.

The invention claimed is:

1. A hearing device, comprising:

a microphone array including at least a first microphone and a second microphone;

an apparatus for producing a directivity of said microphone array, said apparatus having a first input and a second input;

a coupling device for coupling said first microphone to said first input of said apparatus and for coupling said second microphone to said second input of said apparatus;

said coupling device being configured to simultaneously couple said first microphone to both said first and second inputs of said apparatus;

said coupling device being configured to simultaneously couple said second microphone to both said first and second inputs of said apparatus; and said coupling device configured to allow selective interruption of a signal path from said second microphone to said apparatus for producing a directional characteristic.

2. The hearing device according to claim 1, wherein said coupling device comprises a delay element, and wherein said first microphone can be coupled to said second input through said delay element.

3. The hearing device according to claim 2, wherein said delay element is a component of said apparatus for producing a directivity.

4. The hearing device according to claim 1, wherein said coupling device includes at least one apparatus for multiplying a microphone-signal amplitude by a weighting factor.

5. The hearing device according to claim 4, wherein said coupling device is configured to weight a microphone signal of said first microphone by a weighting factor b, where $0<b<1$, and to weight a microphone signal of said second microphone by a weighting factor c, where $c=1-b$.

6. The hearing device according to claim 4, wherein said coupling device is configured such that the weighting of a microphone-signal amplitude and/or a delay of the microphone signal is a function of a microphone-signal frequency.

7. The hearing device according to claim 1, wherein said coupling device is configured such that a weighting of a microphone-signal amplitude and/or a delay of the microphone signal is a function of a microphone-signal frequency.

8. In a hearing device having a microphone array with microphones to be coupled to respective inputs of an apparatus for producing a directivity of the microphone array, a method of producing an omnidirectional directional characteristic for the hearing device, the method which comprises:

coupling two of the microphones each to at least two of the inputs of the apparatus; and selectively interrupting a signal path from a second of the two of the microphones to the apparatus for producing the directional characteristic.

* * * * *